US006460499B1

(12) United States Patent
Mason et al.

(10) Patent No.: US 6,460,499 B1
(45) Date of Patent: Oct. 8, 2002

(54) HYDRAULIC LIFTER ASSEMBLY

(75) Inventors: John R. Mason, Plymouth; David A. Koblic, Oakfield; Jason Janeczko, Fon du Lac, all of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/761,353

(22) Filed: Jan. 16, 2001

(51) Int. Cl.[7] ..... F01L 1/14

(52) U.S. Cl. ..... 123/90.55; 123/90.12; 123/90.48; 123/90.61; 123/90.63

(58) Field of Search ..... 123/90.12, 90.48, 123/90.49, 90.52, 90.55, 90.56, 90.57, 90.61, 90.33, 90.35; 74/569

(56) References Cited

U.S. PATENT DOCUMENTS

| | | | | |
|---|---|---|---|---|
| 2,539,877 | A | 1/1951 | Voorhies | 123/90 |
| 2,938,508 | A | 5/1960 | Papenguth | 123/90 |
| 2,954,015 | A | 9/1960 | Line | 123/90 |
| 2,962,012 | A | 11/1960 | Howson | 123/90 |
| 3,053,239 | A | 9/1962 | Pechenik | 123/90 |
| 3,070,080 | A | 12/1962 | Van Slooten | 123/90 |
| 3,139,078 | A | 6/1964 | Van Slooten | 123/90 |
| 3,262,434 | A | 7/1966 | Kuchen et al. | 123/90 |
| 4,184,464 | A | 1/1980 | Svihlik | 123/90.55 |
| 4,291,652 | A | 9/1981 | Trzoska | 123/90.57 |
| 4,470,382 | A | 9/1984 | Muto | 123/90.59 |
| 4,541,374 | A | 9/1985 | Kodama | 123/90.59 |

FOREIGN PATENT DOCUMENTS

| | | | |
|---|---|---|---|
| JP | 59-200006 | * 11/1984 | 123/90.12 |

* cited by examiner

*Primary Examiner*—Thomas Denion
*Assistant Examiner*—Jaime Corrigan
(74) *Attorney, Agent, or Firm*—Baker & Daniels

(57) ABSTRACT

A lifter assembly for an internal combustion engine, including an elongate sleeve having an upper radial wall portion provided with oil feed and oil bleed holes through which oil respectively enters and exits the lifter assembly. An elongate, hollow lifter body closed at one end is reciprocatingly disposed within the sleeve, and has a plunger reciprocatingly disposed therein. The plunger has an internal cavity at least partially defining a low pressure oil reservoir which is in at least periodic fluid communication with the oil feed hole. A high pressure oil reservoir is at least partially defined by the plunger and the lifter body closed end, and is in one-way fluid communication with the low pressure oil reservoir. A cap is reciprocatingly disposed within the sleeve and engaged with the plunger. Seals are provided which preclude oil from exiting the lifter assembly through the ends of the sleeve.

26 Claims, 4 Drawing Sheets

HYDRAULIC LIFTER ASSEMBLY

BACKGROUND OF THE INVENTION

The field of the present invention relates to hydraulic lifters or tappets for internal combustion engines, particularly such lifters or tappets which are substantially horizontally oriented.

Prior known engines that contain hydraulic lifter assemblies for actuating cylinder intake and exhaust valves are well known in the art. The camshaft contains one or more lobes which slidably engage the foot of the lifter, and force open valves which are spring-biased into their closed positions. Gases are conducted into, or exhausted from, the combustion chamber of the engine past the valves, which are fitted into ports provided in a cylinder head or the cylinder block. The combustion chamber normally includes a cylinder, over which the cylinder head is disposed, and in which a piston reciprocates; the piston is operably coupled to a rotatable crankshaft, which has an axis of rotation normally parallel with that of the camshaft. In the well known manner, combustion within the chamber forces the piston away from the head, driving the crankshaft. In a single cylinder engine, angular inertia of the crankshaft causes the reciprocating piston to approach the head. In multiple cylinder engines, the reciprocating piston is also urged toward the head under power of the crankshaft as pistons in other cylinders are similarly urged away from their respective heads during combustion therein.

The camshaft is driven by the crankshaft, and may be operably coupled by means of a gear drive, a belt drive or a chain drive, all of which are well known in the art and provide the proper camshaft/crankshaft drive ratio. In a four stroke engine, the crankshaft rotates twice for each rotation of the camshaft, and each piston successively undergoes compression, power, exhaust and intake strokes in each cycle. Ignition of a fuel/air mixture within the combustion chamber, which causes combustion therein, occurs at or near the beginning of the power stroke. During the compression and power strokes, the exhaust and intake valves are normally closed. During the exhaust stroke or intake stroke, the respective exhaust valve or intake valve is open, and gas respectively exits or enters the cylinder past the valve. The timing and duration of the valve openings and closings, as well as the distance by which the valve is opened, is controlled by the profile of the cam lobes.

In two stroke engines, each piston successively undergoes compression/exhaust and power/intake strokes in each cycle. During a portion of the compression stroke, the exhaust valve is open; during a portion of the power stroke, the suction valve is open. Thus, for each rotation of the camshaft, in a two stroke engine the crankshaft rotates once.

As noted above, the foot of each lifter rides on a cam lobe. As the lifter foot follows the profile of the cam lobe, the spring-biased valve is forced off of its seat, which surrounds the respective port, to open the valve, and is allowed to return to its seat to close the valve. The valves and the camshaft lobes are thus operably engaged through the lifters, as well as through any intervening valve rods or rocker arm assemblies which are also included in the valve train to manipulate the direction of motion and/or proportionally change the amount of lift imparted to the valve, as known in the art.

Lifters or tappets are generally of two types: Solid and hydraulic. Solid lifters are comparatively cheaper, include fewer components, and offer a somewhat greater degree of control over valve travel because they do not compress.

Solid lifters, however, require periodic adjustment to maintain proper valve train operating tolerances. When out of tolerance, solid lifters are prone to cause undesirable noise during engine operation as the lifter foot and cam lobes, or other parts of the valve train, slightly separate and subsequently strike each other.

Hydraulic lifters are comparatively more expensive than solid lifters and include more component parts. Nevertheless, they are virtually maintenance-free and normally very quiet. Further, in most engines, hydraulic lifters offer a satisfactory degree of control over valve travel, despite their being compressible.

The hydraulic lifter assembly may comprise an elongate, usually cylindrical body, closed on one end by the portion forming the foot of the lifter. The lifter body is normally slidably disposed in a bore provided in the cylinder block or valve head which extends perpendicularly relative to the axis of rotation of the camshaft. The foot of each lifter body rides on the profile of a different cam lobe as the lifter body reciprocates within its bore.

A hollow plunger, also usually cylindrical, is slidably disposed within the lifter body, and is spring-biased away from the foot. The end of the plunger opposite the foot of the lifter body engages its valve, perhaps, as mentioned above, through valve rods and/or rocker arms. The plunger contains a low pressure reservoir into which engine oil is received. The lifter body has a high pressure oil, expansible reservoir located between the foot and the plunger. The high pressure reservoir is in one-way fluid communication with, and receives oil from, the low pressure reservoir through a check valve.

During operation, as the highest part or peak of the rotating cam lobe moves out from under the foot of the lifter body, and the lifter body consequently advances radially toward the axis of rotation of the camshaft, the spring within the lifter assembly forces the foot away from the plunger, and oil from the low pressure reservoir is drawn through the check valve into the high pressure reservoir, thereby fully charging the high pressure reservoir with oil as the lifter foot encounters the base or circular portion of the cam lobe. As the lifter foot encounters the ramp portion of the cam lobe which extends from the base to the peak, the lifter body is forced radially away from the axis of rotation of the camshaft. The lifter assembly spring and the oil in the high pressure reservoir is compressed, and the plunger forces the valve open. The compressed oil in the high pressure reservoir is forced therefrom through clearances between the valve body and the plunger, and subsequently from between the valve body and the bore in which it reciprocates. Thus, a hydraulic lifter forms a dashpot.

As the reciprocating lifter body again advances towards the axis of rotation of the camshaft, oil is again drawn from the low pressure reservoir to the high pressure reservoir as the lifter assembly spring forces the lifter body and plunger axially apart, and the cycle continues.

To ensure quiet and reliable operation of the lifter assembly, it is important that an adequate supply of oil be provided to both the low and high pressure reservoirs at all times. A problem often encountered is that, during engine shutdown periods, oil will leak or drain from the reservoirs of the lifter assemblies. This leakdown phenomena is particularly common in engines which have horizontally-oriented lifter assemblies. Vertically-oriented lifter assemblies do not experience this problem to the same degree as horizontally-oriented lifter assemblies do, because the lifter bodies of most vertically-oriented lifter assemblies are closed by foot-forming lower portions and therefore have a tendency to retain oil therein.

Upon subsequent startup of engines having previous horizontally-oriented lifter assemblies, at least the high pressure reservoirs, and perhaps also the low pressure reservoirs, of the lifter assemblies may be depleted of oil and largely contain air. Consequently, these lifter assemblies compress too readily and too far, resulting in undesirable noise or improper valve timing, at least temporarily, as well as possible damage to components of the valve train (including the lifter assemblies themselves). Thus, a hydraulic lifter assembly which precludes oil from leaking therefrom, and air from entering thereinto, during engine shutdown periods is highly desirable.

SUMMARY OF THE INVENTION

The present invention addresses the above-mentioned leakdown problem by providing a hydraulic lifter assembly which allows no oil to leak out of its reservoirs during engine shutdown periods.

The present invention provides a lifter assembly for an internal combustion engine, including an elongate sleeve having an upper radial wall portion provided with oil feed and oil bleed holes therethrough, through which oil respectively enters and exits the lifter assembly. An elongate, hollow lifter body is reciprocatingly disposed within the sleeve, the lifter body being closed at one end thereof. A plunger is reciprocatingly disposed within the lifter body and has an internal cavity, a low pressure oil reservoir at least partially defined by the plunger internal cavity, the low pressure oil reservoir in at least periodic fluid communication with the oil feed hole, whereby oil from the oil feed hole is received into the low pressure oil reservoir. A high pressure oil reservoir is at least partially defined by the plunger and the lifter body closed end, and is in one-way fluid communication with the low pressure oil reservoir, whereby oil is received into the high pressure reservoir from the low pressure oil reservoir. A cap is reciprocatingly disposed within the sleeve and engaged with the plunger. First and second seals are located between an outer circumferential surface of the lifter body and an outer circumferential surface of the cap, respectively, and an inner circumferential surface of the sleeve, the seals respectively located between the oil feed hole and one end of the sleeve, and the oil bleed hole and the other end of the sleeve, whereby oil is precluded from exiting the lifter assembly through the ends of the sleeve.

The present invention also provides an arrangement of first and second lifter assemblies, wherein each of the first and second lifter assemblies includes a sleeve in which a lifter body reciprocates, each sleeve provided with an oil feed hole through which oil is provided to the lifter body therein. The oil feed holes of the first and second lifter assemblies are in parallel fluid communication with a source of oil which includes a first oil conduit. A circumferential groove is located about the first lifter assembly sleeve, the oil feed hole of the first lifter assembly sleeve opening into the circumferential groove, and a second conduit is provided through which the circumferential groove and the second lifter assembly oil feed hole are placed in fluid communication.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one embodiment of the present invention, and such exemplification is not to be construed as limiting the scope of the invention in any manner.

DETAILED DESCRIPTION OF THE INVENTION

Figure 1:
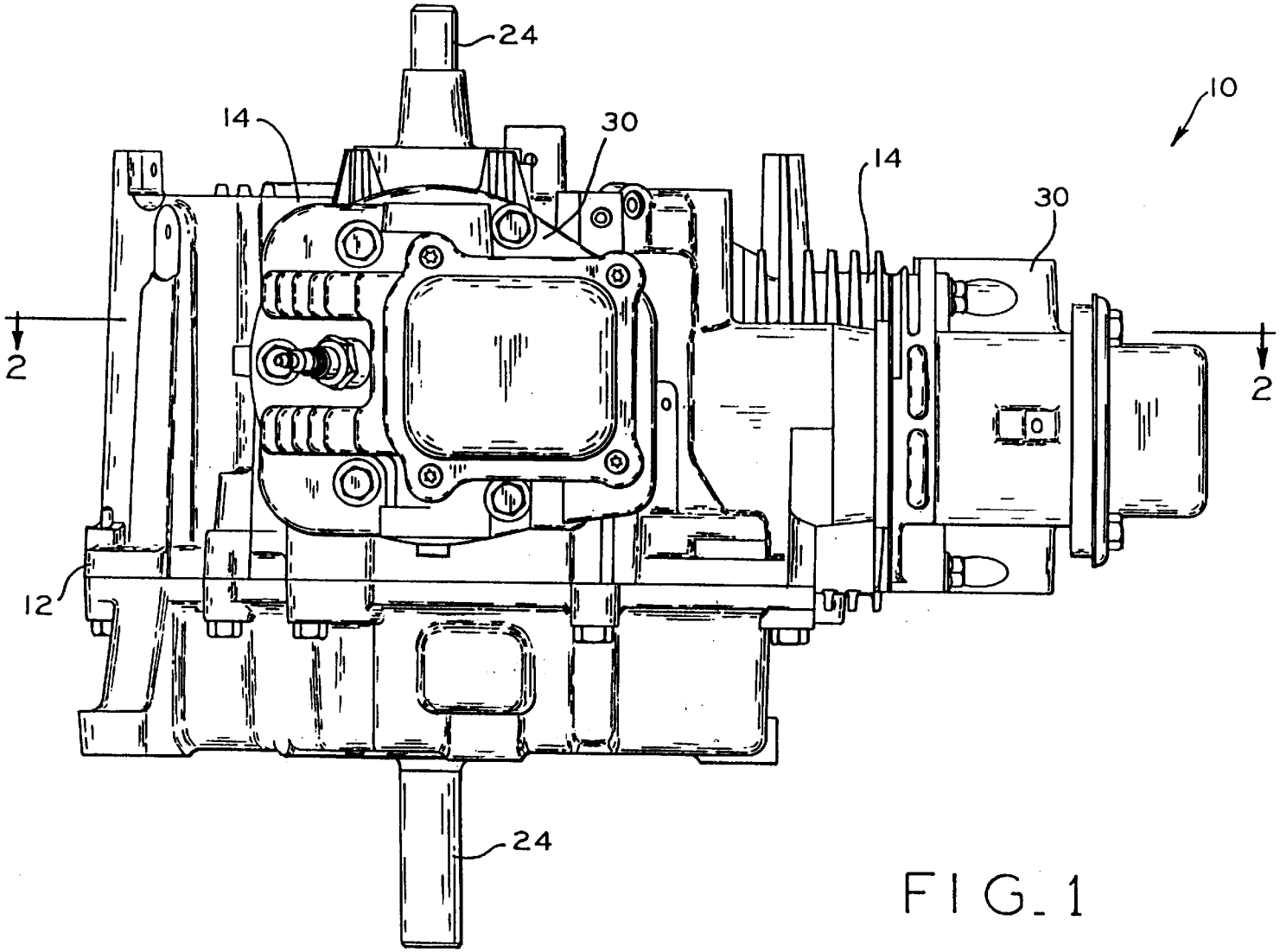
FIG. 1 is a side view of a first embodiment of an engine into which the inventive lifter assembly and arrangement is installed.
Figure 2:
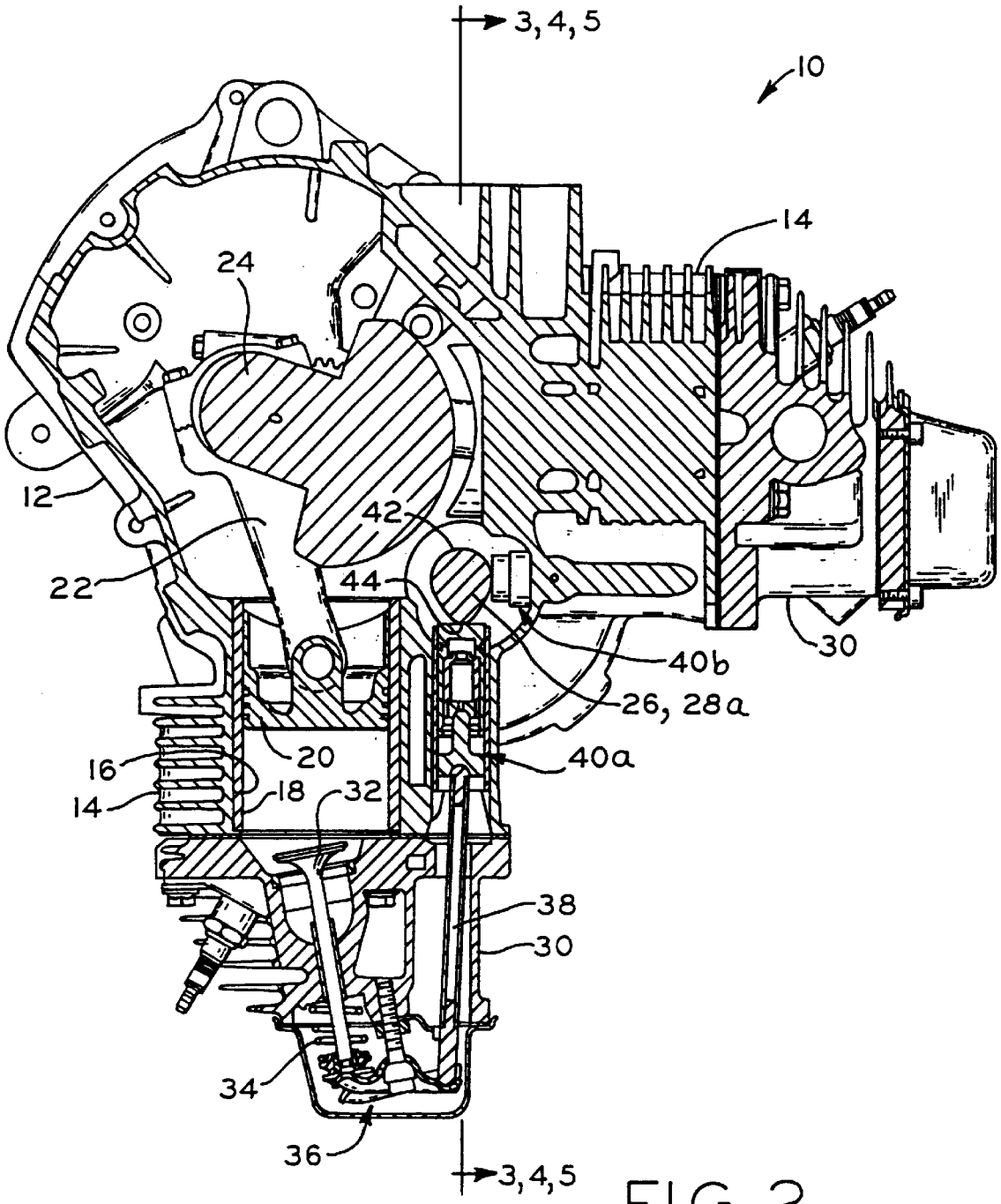
FIG. 2 is a sectional view of the engine of FIG. 1 along line 2—2.

FIG. 1 shows engine 10 which is of the four stroke, V-twin cylinder variety having crankcase 12. Crankcase 12 is formed with cylinder portions 14 within each is formed a cylinder bore 16, as shown in FIG. 2. Each cylinder bore 16 may be provided with a cylinder liner 18 along which each piston 20 reciprocatingly slides in the well known manner. Each piston 20 is attached via a connecting rod 22 to crankshaft 24. In engine 10, crankshaft 24 is vertically oriented and, with reference to FIG. 1, extends from the top and bottom of crankcase 12. The present invention should not be construed as being limited to vertical shaft engines, however.

Disposed within crankcase 12 camshaft 26 which has an axis of rotation parallel to that of crankshaft 24 and which is operably coupled thereto, as through a gear, chain or belt drive. Crankshaft 26 is provided with cam lobes 28*a* through 28*d*. Referring to FIG. 2 it can be seen that each of cam lobes 28 includes a base or circular portion 42, and a peak 44, as described above. As will be discussed further herein below, each cam lobe is slidably engaged with the foot of a lifter assembly.

Located over each cylinder portion 14 is a cylinder head 30 which, with the cylinder bore 16 or liner 18, and piston 20, define the combustion chamber. In engine 10, each cylinder head 30 is provided with two valves 32: one for intake to the combustion chamber, and one for exhaust from the combustion chamber, as explained above. Valves 32 are each biased into their closed position by means of a compression spring 34. Valves 32 are urged into their respective open positions through rocker arm assembly 36 which couples each of the valves to an associated push rod 38. Each push rod 38 extends between rocker arm assembly 36 and a lifter assembly 40*a* through 40*d*. Each of lifter assemblies 40*a* through 40*d* are identical, and lifter assembly 40*d* is not shown in the drawings.

Figure 3:
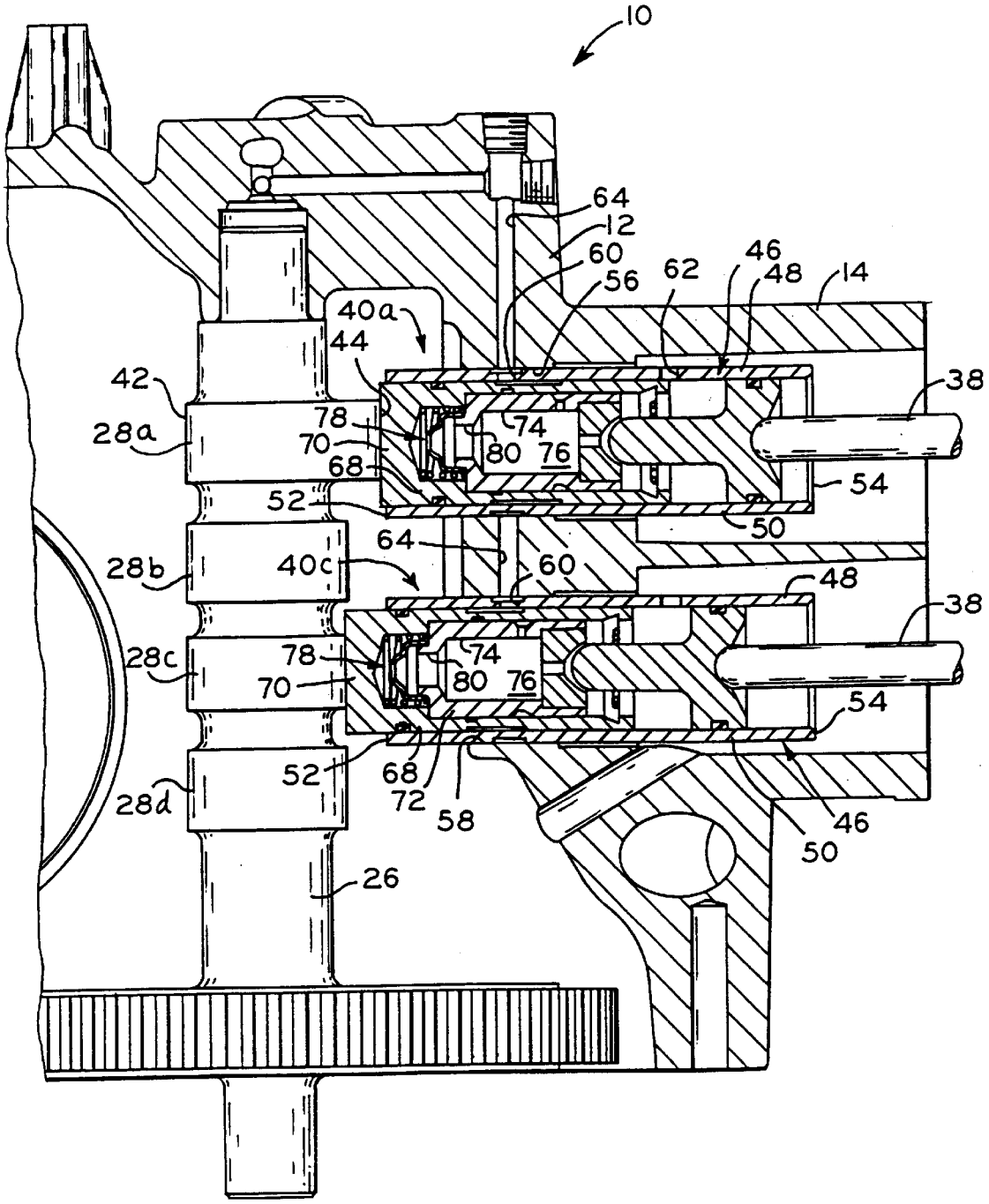
FIG. 3 is an enlarged, fragmentary sectional view of the engine of FIG. 2 along line 3—3, showing the inventive arrangement of lifter assemblies.

As can be seen from FIGS. 2 and 3, lifter assemblies 40*a* and 40*c*, which respectively slidably engage cam lobes 28*a* and 28*c*, control the valves 32 in one cylinder head 30. Lifter assemblies 40*b* and 40*d* (the latter not shown) slidably engage cam lobes 28*b* and 28*d*, respectively, and control valves 32 in the other cylinder head 30.

Figure 4:
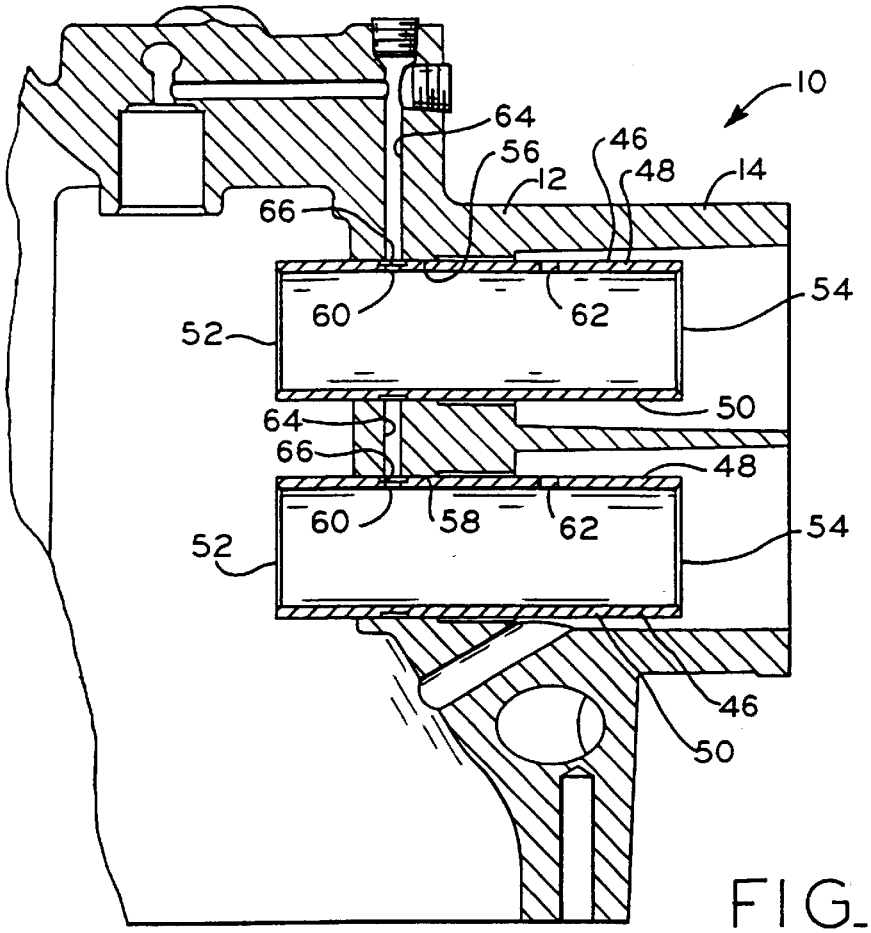
FIG. 4 is an enlarged, fragmentary sectional view of the engine of FIG. 2 along line 4—4, showing the lifter sleeves without the lifter bodies therein.

Each lifter assembly 40 includes cylindrical sleeve 46 having upper radial wall 48 nd lower radial wall 50. Each sleeve 46 also has an open inward end 52 which faces cam shaft 26, and an axially opposite, open outward end 54. As best shown in FIG. 4, in engine 10 each cylinder portion 14 is provided with an upper bore 56 and, located below upper bore 56, a lower bore 58; sleeves 46 are interference fitted into bores 56 and 58. Located near inward end 52 of each sleeve 46 is oil feed hole 60. located in upper radial wall 48. In the shown embodiment, oil feed hole 60 is located at the vertically uppermost portion of upper radial wall 48. Located near outward end 54 is oil bleed hole 62, also located in the vertically uppermost portion of upper radial wall 48.

Crankcase 12 is provided with oil supply bore 64 which is supplied with pressurized lubricating oil, as from an oil pump. As shown, oil supply bore 64 extends through upper bore 56 and continues to lower bore 58. In the outer circumferential surface of sleeve 46 is provided annular oil supply groove 66 into which opens oil feed hole 60. Sleeve 46 is positioned in bores 56 and 58 such that groove 66 is in communication with oil supply bore 64. Those skilled in the art will now recognize that the pressurized oil supplied to the lifter assemblies through oil supply bore 64 will be able to reach both lifter assemblies of a given cylinder portion independently. Referring to FIG. 3, only a portion of the oil first reaching groove 66 in the sleeve of lifter assembly 40*a* enters its oil feed hole 60, the remainder of that oil is supplied to groove 66 of lifter assembly 40*c* through the portion of oil supply bore 64 which extends between bores 56 and 58. Thus it will be understood that lifter assemblies 40*a* and 40*c* are in parallel fluid communication through oil supply bore 64 and oil will be supplied to each of these lifter assemblies independently. As will be discussed further herein below, oil is received within each lifter assembly 40 through its oil feed hole 60 and exits each lifter assembly 40 through its oil bleed hole 62. Each oil bleed hole 62 is in open fluid communication with the interior of crankcase 12.

Slidably disposed within each sleeve 46 is hollow cylindrical lifter body 68 which is closed at one end by a portion 70 which forms the lifter foot on the exterior of that axial end of the lifter body. As best shown in FIG. 3, each lifter foot is in sliding engagement with the surface of a cam lobe 28. In the usual manner, the lifter foot is urged into sliding abutment with the surface of cam lobe 28 by the force of spring 34 (FIG. 2) which acts on the lifter assembly through rocker arm assembly 36 and push rod 38. As cam shaft 26 rotates, lifter body 68 reciprocates within its respective sleeve 46.

Reciprocatingly disposed within each lifter body 68 is cylindrical plunger 72 which is formed with internal cavity 74. The walls of cavity 74 partially define a low pressure oil reservoir 76 within the plunger 72. As will be described further herein below, low pressure oil reservoir 76 is in at least periodic fluid communication with oil feed hole 60, whereby oil received into the oil feed hole is received into the low pressure oil reservoir 76.

High pressure oil reservoir 78 is defined by plunger 72 and the interior of lifter body 68 near lifter body closed portion 70. Plunger 72 is provided with passage 80 over which is provided check valve 82. Low pressure oil cavity 76 is in one way fluid communication with high pressure oil reservoir 78 through passage 80 and check valve 82. The check valve allowing flow from the low pressure reservoir 76 to high pressure reservoir 78. Normally, if the pressure of oil in high pressure reservoir 78 is greater than that of low pressure reservoir 76, check valve 82 will remain closed and no oil will transfer between the two reservoirs.

Oil received into sleeve 46 through oil feed hole 60 lubricates the interface between the inner cylindrical surface of the sleeve and the outer cylindrical surface of lifter body 68. This oil is also received in wide first circumferential groove 84 provided in the outer cylindrical surface of the lifter body. The inner cylindrical surface of the lifter body is provided with second circumferential groove 86 which is in fluid communication with first circumferential groove 84 through first radially directed passage 88 provided in the lifter body. Plunger 72 is provided with third circumferential groove 90 in its outer radial surface. Radially directed second passage 92 is located in third circumferential groove 90 and extends through the wall of the plunger to convey oil to low pressure reservoir 76 therein.

Figure 5:
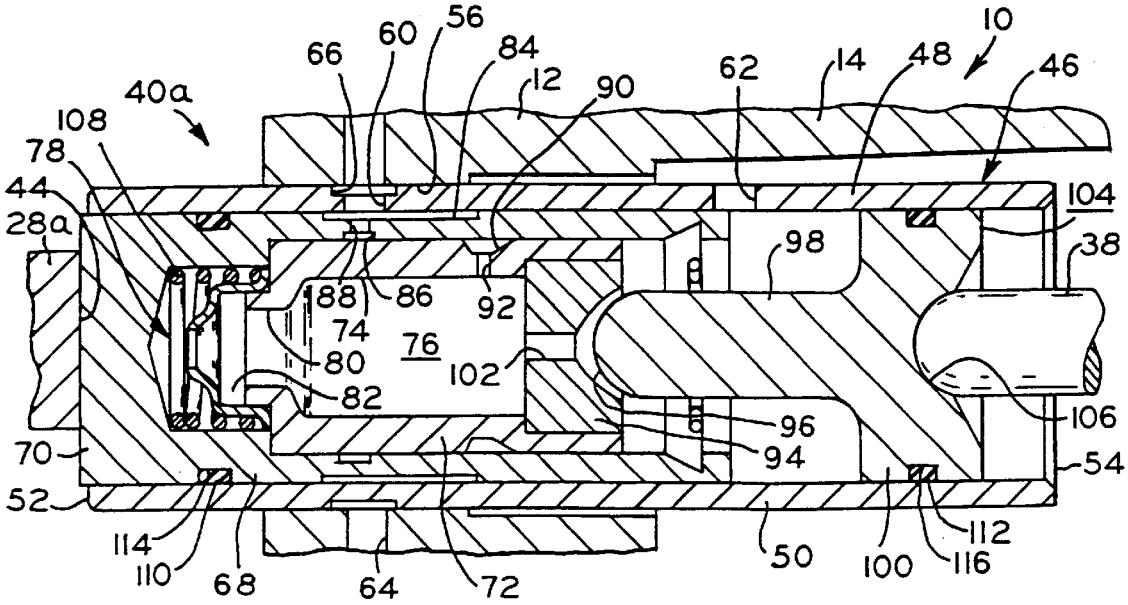
FIG. 5 is a further enlarged, fragmentary sectional view of the engine of FIG. 2 along line 5—5, showing one of the inventive lifter assemblies.

As best shown in FIG. 5, first circumferential groove 84 is of sufficient width that regardless of the position along sleeve 46 which lifter body 68 assumes during reciprocation, oil feed hole 60 and first groove 84 are always in fluid communication with each other. Also, although second groove 86 and third groove 90 are not in superposed relation to one another, there is sufficient clearance between the slidably interfacing inner surface of valve body 68 and outer surface of plunger 72 to allow sufficient oil flow from first radial passage 88 to second radial passage 92 to feed oil to the low pressure oil reservoir.

Socket 94 is fitted into the end of plunger 72 opposite that in which passage 80 is provided and receives hemispherical tip 96 of stem 98 extending from an axial surface of short cylindrical cap 100 which is slidably received in sleeve 46. Metering passage 102 is provided through socket 94 to provide oil from low pressure oil reservoir 76 to lubricate the interface between socket 94 and cap tip 96. Axial surface 104 of cap 100, opposite that from which stem 98 extends, is provided with cup 106 in which the end of valve push rod 38 is received.

Compression spring 108 is provided in high pressure oil reservoir 78 and acts on lifter body closed portion 70 and the interfacing surface of plunger 72 to urge plunger 72 away from lifter body closed end 70. Oil in the high pressure oil reservoir 78 is allowed to leak along the interface between the inner cylindrical surface of the lifter body and the outer cylindrical surface of the plunger. Oil is prevented from leaking from the lifter assembly through the annular clearances between lifter body 68 and sleeve 46, and between cap 100 and sleeve 46, by first and second O-rings 110, 112 respectively provided in circumferential grooves 114 and 116 provided in the lifter body and the cap. Thus, oil is only allowed to exit lifter assembly 40 through bleed hole 62 in sleeve 46. Notably, bleed hole 62 is positioned such that it is never blocked or covered by lifter body 68 or cap 100. As noted above, each bleed hole 62 is in open fluid communication with the interior of crankcase 12. Those skilled in the art will now appreciate that O-rings 110, 112, as well as the upwardly oriented feed and bleed holes 62 in sleeve 46, prevent oil leakage from lifter assemblies 40 during engine shutdown periods.

While the present invention has been described as having an exemplary design, the present invention can be further modified within the spirit and scope of this disclosure. This application is therefore intended to cover any variations, uses, or adaptations of the invention using its general principles. For example, the scope of the present invention encompasses lifter assemblies for two stroke spark ignition engines and compression ignition (i.e., diesel) engines, as well as for four stroke spark ignition engines such as engine 10. Further, this application is intended to cover such departures from the present disclosure as come within known or customary practice in the art to which this invention pertains.

What is claimed is:

1. An arrangement of first and second lifter assemblies, wherein each of said first and second lifter assemblies comprises a sleeve in which a lifter body reciprocates, each said sleeve provided with an oil feed hole through which oil is provided to the lifter body therein, the oil feed holes of said first and second lifter assemblies being in parallel fluid communication with a source of oil, said source of oil comprising a first oil conduit, a circumferential groove is located about said first lifter assembly sleeve, said oil feed hole of said first lifter assembly sleeve opening into said circumferential groove, and a second conduit is provided through which said circumferential groove and said second lifter assembly oil feed hole are placed in fluid communication.

2. The lifter assembly arrangement of claim 1, wherein said first and second conduits are axially aligned.

3. The lifter assembly arrangement of claim 2, wherein said first lifter assembly is located above said second lifter assembly.

4. The lifter assembly arrangement of claim 2, wherein said first conduit approaches said first lifter from above.

5. A lifter assembly for an internal combustion engine, comprising:

an elongate sleeve having an upper radial wall portion, said upper radial wall portion being provided with an oil feed hole through which oil enters said lifter assembly, and an oil bleed hole through which oil exits said lifter assembly, said oil feed hole and said oil bleed hole extending through said upper radial wall portion;

an elongate lifter body reciprocatingly disposed within said sleeve, said lifter body being hollow and closed at one end thereof;

a plunger reciprocatingly disposed within said lifter body, said plunger having an internal cavity;

a low pressure oil reservoir at least partially defined by said plunger internal cavity, said low pressure oil reservoir in at least periodic fluid communication with said oil feed hole, whereby oil from said oil feed hole is received into said low pressure oil reservoir;

a high pressure oil reservoir at least partially defined by said plunger and said lifter body closed end, said low pressure oil reservoir and said high pressure oil reservoir in one-way fluid communication, whereby oil is received into said high pressure reservoir from said low pressure oil reservoir;

a cap reciprocatingly disposed within said sleeve, said cap being engaged with said plunger;

a first seal located between an outer circumferential surface of said lifter body and an inner circumferential surface of said sleeve, said first seal located between said oil feed hole and one end of said sleeve, and a second seal located between an outer circumferential surface of said cap and said sleeve inner circumferential surface, said second seal located between said oil bleed hole and the other end of said sleeve, whereby oil is precluded from exiting said lifter assembly through the ends of said sleeve.

6. The lifter assembly of claim 5, wherein said lifter body reciprocates in substantially horizontal directions.

7. The lifter assembly of claim 5, wherein said oil feed hole and said oil bleed hole are spaced along the length of said sleeve.

8. The lifter assembly of claim 5, wherein said high pressure oil reservoir is in restricted fluid communication with said oil bleed hole, whereby oil from said high pressure oil reservoir is received, at a lower pressure, into said oil bleed hole.

9. The lifter assembly of claim 8, wherein an inner surface of said lifter body and an outer surface of said plunger interface and form a clearance therebetween, said high pressure oil reservoir in fluid communication with said oil bleed hole through said clearance.

10. The lifter assembly of claim 5, wherein said sleeve, said lifter body and said plunger are cylindrical, and said cap has a cylindrical portion on which said cap outer circumferential surface is located.

11. The lifter assembly of claim 10, wherein said lifter body outer circumferential surface and said cap cylindrical portion outer circumferential surface are each provided with circumferential grooves in which said first and second seals are respectively disposed.

12. The lifter assembly of claim 5, further comprising a passage extending between said low pressure oil reservoir and said high pressure oil reservoir, and a check valve disposed over said passage, whereby oil may flow in only one direction through said passage.

13. The lifter assembly of claim 12, wherein oil flow through said passage is from said low pressure oil reservoir to said high pressure oil reservoir.

14. The lifter assembly of claim 1, wherein said plunger is biased away from said lifter body closed end.

15. The lifter assembly of claim 14, further comprising a compression spring disposed in said high pressure oil reservoir, said spring abutting said lifter body closed end and said plunger, whereby said plunger is biased away from said lifter body closed end.

16. The lifter assembly of claim 5, wherein said cap has a tip and further comprising a socket disposed between said plunger and said cap, said socket partially defining said low pressure oil reservoir and having a recess into which said cap tip is received.

17. The lifter assembly of claim 16, wherein said socket includes a metering passage extending between said low pressure oil reservoir and said recess, the interface between said socket and said cap tip being provided with oil through said metering passage.

18. The lifter assembly of claim 5, wherein said oil feed hole and said oil bleed hole are each located at the uppermost portion of said sleeve upper radial wall portion.

19. The lifter assembly of claim 5, wherein said lifter body has an outer circumferential surface in which a first circumferential groove is located, said first circumferential groove at all times open to said sleeve oil feed hole, said lifter body having an inner circumferential surface in which a second circumferential groove is located, said first and second circumferential grooves in fluid communication through a first passage extending through said lifter body, said plunger has an outer circumferential surface in which a third circumferential groove is located, said third circumferential groove and said low pressure oil reservoir in fluid communication through a second passage extending through said plunger, and said second and third circumferential grooves are in at least periodic fluid communication.

20. The lifter assembly of claim 5, wherein said lifter body closed end forms a lifter foot.

21. The lifter assembly of claim 5, wherein an oil chamber is formed between said cap and said lifter body, said oil bleed hole at all times open to said oil chamber, and oil from said high pressure oil reservoir is received in said oil chamber.

22. In combination with the lifter assembly of claim 5, a second said lifter assembly, said oil feed holes of said first and second lifter assemblies in parallel fluid communication with a source of oil.

23. The combination of claim 22, wherein said source of oil includes a first oil conduit, and the sleeve of said first lifter assembly has an outer circumferential surface in which a circumferential groove is located, said first lifter assembly oil feed hole located in said circumferential groove, said first oil conduit opening into said first lifter assembly circumferential groove, and said first oil conduit is in fluid communication with the oil feed hole of said second lifter assembly through a second conduit, said second conduit extending between said second lifter assembly and said circumferential groove of said first lifter assembly.

24. The combination of claim 23, wherein said first and second oil conduits are axially aligned.

25. The combination of claim 23, wherein said first oil conduit approaches said first lifter assembly from above said first lifter assembly.

26. The combination of claim 25, wherein said first lifter assembly is located above said second lifter assembly.

* * * * *